US005965073A

United States Patent [19]

Geier et al.

[11] Patent Number: 5,965,073

[45] Date of Patent: Oct. 12, 1999

[54] PROCESS AND DEVICE FOR PRODUCING POLYESTER YARNS

[75] Inventors: Rudolf Geier, Essen; Jürgen Hartig, Gladbeck; Ingo Eifländer, Essen, all of Germany

[73] Assignee: John Brown Deutsche Engineering GmbH, Bochum, Germany

[21] Appl. No.: 09/011,013

[22] PCT Filed: Jul. 19, 1996

[86] PCT No.: PCT/EP96/03182

§ 371 Date: Feb. 2, 1998

§ 102(e) Date: Feb. 2, 1998

[87] PCT Pub. No.: WO97/06293

PCT Pub. Date: Feb. 20, 1997

[30] Foreign Application Priority Data

Aug. 8, 1995 [DE] Germany ..... 195 29 135

[51] Int. Cl.[6] ..... D01D 5/084; D01D 5/088; D01D 5/16; D01F 6/62

[52] U.S. Cl. ..... 264/103; 264/210.7; 264/210.8; 264/211.12; 264/211.15; 264/211.17; 425/66; 425/377; 425/378.2; 425/379.1; 425/382.2; 425/464

[58] Field of Search ..... 264/103, 210.7, 264/210.8, 211.12, 211.15, 211.17, 555; 425/66, 72.2, 377, 378.2, 379.1, 382.2, 464

[56] References Cited

U.S. PATENT DOCUMENTS

| | | | |
|---|---|---|---|
| 4,743,504 | 5/1988 | Carr | 264/210.8 X |
| 5,019,316 | 5/1991 | Ueda et al. | 264/211.17 X |
| 5,558,825 | 9/1996 | Ueda et al. | 264/103 |
| 5,698,146 | 12/1997 | Schippers et al. | 264/103 |

FOREIGN PATENT DOCUMENTS

| | | |
|---|---|---|
| 4224453 | 2/1993 | Germany . |
| WO 92/01093 | 1/1992 | WIPO . |

*Primary Examiner*—Leo B. Tentoni
*Attorney, Agent, or Firm*—Herbert Dubno

[57] ABSTRACT

Polyester yarn is produced from melt spun filament by prestretching the filaments individually in counterflow with a gaseous medium and then afterstretching the polyester filaments with an individual titer of 1.0 dtex to 7.5 dtex with a stretching ratio of 1:1.5 to 1:1.15 at a temperature of 80° to 250° C. The filaments are collected and then wound up as a yarn at a speed of 5000 to 8000 m/min.

10 Claims, 1 Drawing Sheet

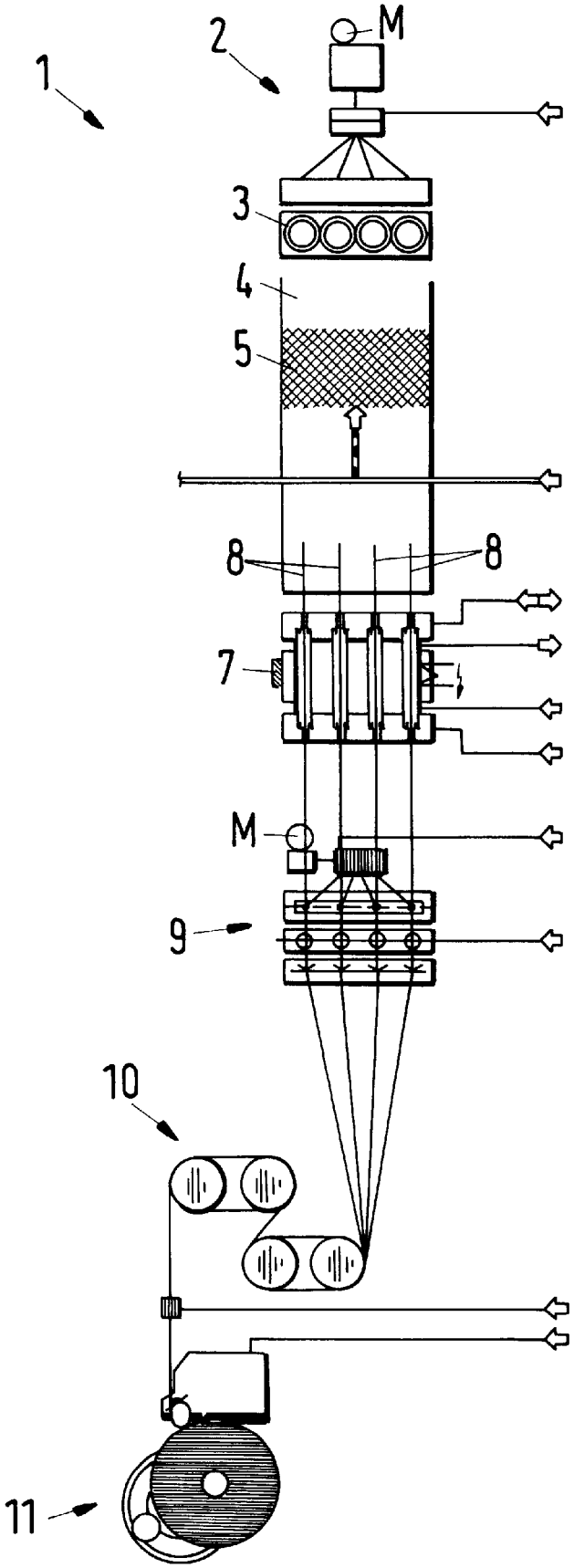
1
2
M
3
4
5
8
8
7
M
9
10
11

PROCESS AND DEVICE FOR PRODUCING POLYESTER YARNS

CROSS REFERENCE TO RELATED APPLICATION

This is a national phase of PCT/EP96/03182 filed Jul. 19, 1996 and based upon German application 195 29 135.2 filed Aug. 8, 1995 under the International Convention.

FIELD OF THE INVENTION

The invention relates to a process for producing polyester yarns wherein melt-spun polyester filaments are cooled downstream from a spinning nozzle or spinneret in a cooling zone to at least a congealing temperature and then, for the purpose of stretching, is heated in a heating zone to a temperature above the glass transition temperature or the solidification point, and then for generating the requisite stretching tension is passed in an unbundled orientation through the heating zone and subjected to a stream or blast of a of gaseous medium in counterflow.

BACKGROUND OF THE INVENTION

A process of this type is known in which microfilaments with an individual titer less than 1.0 dtex are drawn through a heating zone with a withdrawal speed up to 8000 m/min for final stretching and are subjected to blowing in counterflow. After this known process, full stretched synthetic resin threads are produced without after treatment which can be worked up into especially fine and tight fabrics (see PCT/DE 9100420).

OBJECT OF THE INVENTION

It is an object of the invention to provide a process and an apparatus which permits fabrication of polyester yarns with optimum characteristics for technological applications in a rational manner.

SUMMARY OF THE INVENTION

These objects are achieved by a process according to the invention wherein the polyester filaments with an individual titer of 1.0 dtex to 7.5 dtex are after-stretched at temperatures of 80° C. to 250° C. with a stretching ratio of 1:1.5 to 1:1.15 and are wound up at a wind-up speed of 5000 m/min to 8000 m/min. From the polyester filaments produced by the process according to the invention, technologically suitable polyester yarns in an overall titer ranger of about 100 dtex to 1100 dtex or greater can be produced, for example, by bundling. By technologically suitable polyester yarns, we mean polyester yarns which are especially suitable for technological applications, namely, for example, as sewing yarns in fabrics in tarpaulin-type fabrics, tent fabrics, sail fabrics, tire cord, hoses, V-belts, conveyor belts, rope, and the like. The polyester filaments fabricated in accordance with the invention and the polyester yarns formed therefrom are characterized by high quality and can be produced in an especially rational manner.

Further important features of the invention are given below. Thus the temperature of the polyester filaments immediately after the melt spinning can amount to 200° C. to 350° C., especially 250° C. to 310° C. The polyester filaments are cooled prior to entry into the heating zone to about 80° C. Thereafter the polyester filaments are advantageously heated to a temperature of 200° C. to 350° C., advantageously 225° C. to 285° C. by a blowing in counterflow and, simultaneously prestretched. To increase the friction resistance or to generate the requisite stretching tension, the polyester filaments are advantageously blown with a quantity of air—the gaseous medium is preferably air—in an amount of 5 $m^3$/h to 25 $m^3$/h in counterflow and with a withdrawal velocity of 3000 m/min to 7500 m/min through the counterflow. While the cooling zone, which is transversely blown through by the cooling air, has a length of 800 mm to 1200 mm, the length of the heating zone with counterflow blowing amounts to 1.2 m to 2.5 m. After emerging from the heating zone usually a preparation process can be carried out upon the prestretched polyester filaments.

Further, according to the teachings of the invention, the air quantity and the temperature of the counterflow air are so adjusted that a thread elongation of less than 50%, preferably 30% to 40% is produced. Furthermore, the withdrawal speed of the polyester filaments, the air quantity and the temperature of the counterflow air are so adjusted that a tensile strength of the polyester filaments greater than 3.2 cN/dtex, advantageously 3.4 cN/dtex to 4.5 cN/dtex, is produced. In addition, it is possible to so adjust air quantity and the temperature of the counterflow air that a hot air shrinkage of less than or equal to 6% (at 177° C.) is achieved.

According to a special feature of the invention, the polyester filaments are after-stretched in conjunction with the counterflow treatment continuously so that the fabrication process is effectively a single-stage process. It is possible within the framework of the invention to subject the after-stretched polyester filaments prior to winding up to possibly a turbulencing and after-preparation treatment. It is also possible within the framework of the invention to after-stretch the polyester filaments in a separate treatment stage, for example on a stretching device like a stretch-twisting or stretch-spinning machine.

The invention also comprises an apparatus for carrying out the claimed process, with at least one spinning nozzle, a cooling zone downstream of the spinning nozzle and a counterflow heating zone downstream of the cooling zone. This apparatus, which is characterized by an especially simple and functionally reliable construction with high production speed, has heated gallets with a gallet temperature of 80° C. to 250° C. downstream of the counterflow heating zone. The gallets are drivable with different gallet speeds to generate a stretching ratio of 1:1.5 to 1:1.15. Downstream of the gallets, a wind-up device is arranged for the after-stretched polyester filaments.

BRIEF DESCRIPTION OF THE DRAWING

The sole FIGURE of the drawing is a diagrammatic sectional view of an apparatus for carrying out the method of the invention.

SPECIFIC DESCRIPTION

The sole FIGURE shows an apparatus according to the invention for producing fully oriented technical polyester yarns. The apparatus is provided with a spinning device 1 with an extruder 2 and a spinning beam as a spinneret 3. The extruder 2 supplies the spinneret 3 with a polyester melt. The starting product for the polyester melt is a polyester granulate in the viscosity range IV 0.60–1.10 dl/g. An after-heating zone 4 is connected to the spinneret 3. There follows then a cooling zone with blowing. To the cooling zone 5 is connected a counterflow heating zone 7 in which the unbundled polyester filaments 8 are blown in counterflow. Thereafter follows a device for preparation treatment and thread bundling at the outlet from the counterflow heating zone 7. Heatable gallets 10 are arranged downstream of the counterflow heating zone. The gallets 10 are drivable with different speeds. A wind-up arrangement 11 for the after-stretched polyester filaments 8 follows the gallets 10. The after-stretched polyester filament 8 and the yarn fabricated herefrom have the following characteristics:

Yield to break: 6.5% to 12%

Tensile strength: 5 cN/dtex to 7.5 cN/dtex

Shrinkage hot air 177° C.: equal to/less than 6.0%

We claim:

1. A process for producing a polyester yarn, comprising the steps of:

(a) melt-spinning polyester filaments;

(b) cooling the melt-spun polyester filaments to at most a congealing temperature;

(c) thereafter heating said filaments in counterflow with a gaseous medium to above the glass transition point of said filaments while simultaneously prestretching said filaments;

(d) thereafter, afterstretching the filaments with an individual titer of 1.0 dtex to 7.5 dtex with a stretching ratio of 1:1.5 to 1:1.15 at a temperature of 80° C. to 250° C.; and (e) thereafter combining said filaments to a yarn and winding up said yarn at a speed of 5,000 m/min to 8,000 m/min.

2. The process according to claim 1 wherein the polyester filaments are subjected to a blowing at a temperature of 200 to 350° C. in counterflow in step (c).

3. The process according to claim 1 wherein the polyester filaments are subjected to blowing in counterflow with an air quantity of 5 $m^3$/h to 25 $m^3$/h in step (c).

4. The process according to claim 1 wherein the polyester filaments are drawn with an extraction speed of 3000 m/min to 7500 m/min through a counterflow blowing stream in step (c).

5. The process according to claim 1 wherein the air and the temperature of the counterflow air are so adjusted that a thread elongation of 30% to 40% is produced.

6. The process according to claim 1 wherein the extraction speed of the polyester filaments, the air quantity and the temperature of the counterflow air are so adjusted that a tensile strength of the polyester filaments of 3.4 cN/dtex to 4.5 cN/dtex, is produced.

7. The process according to claim 1 wherein the air quantity and the temperature of the counterflow air are so adjusted that a hot air shrinkage of at most 6% is produced.

8. The process according to claim 1 wherein the polyester filaments are continuously after-stretched in conjunction with the counterflow treatment.

9. The process according to claim 1 wherein the polyester filaments are after-stretched in a separate treatment stage.

10. An apparatus for carrying out the process according to claim 1 which comprises a spinneret, a cooling zone, downstream of the spinneret and a counterflow heating zone following the cooling zone, wherein the counterflow heating zone is followed by heated gallets with a gallet temperature of 80° C. to 250° C., that the gallets are drivable with different speeds to set a predetermined stretching ratio and that the gallets are followed by a wind-up device for the after-stretched polyester filaments.

* * * * *